US008582796B2

(12) United States Patent
Kimura

(10) Patent No.: US 8,582,796 B2
(45) **Date of Patent: *Nov. 12, 2013**

(54) EARMUFF AND HEADPHONE

(75) Inventor: Tominori Kimura, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 371 days.

This patent is subject to a terminal disclaimer.

(21) Appl. No.: 12/821,868

(22) Filed: Jun. 23, 2010

(65) Prior Publication Data

US 2011/0002475 A1 Jan. 6, 2011

(30) Foreign Application Priority Data

Jul. 6, 2009 (JP) ..... 2009-159728

(51) Int. Cl.
*H04R 25/00* (2006.01)

(52) U.S. Cl.
USPC ..... 381/373; 381/371; 2/209

(58) Field of Classification Search
USPC ..... 381/370, 371, 372, 373, 374, 71.6, 380, 381/378, 377; 2/209; 181/129
See application file for complete search history.

(56) References Cited

U.S. PATENT DOCUMENTS

| | | | | | |
|---|---|---|---|---|---|
| 3,644,939 | A | * | 2/1972 | Beguin | 2/209 |
| 3,798,393 | A | * | 3/1974 | Gorike | 381/372 |
| 4,027,117 | A | * | 5/1977 | Nakamura | 381/372 |
| 4,572,324 | A | * | 2/1986 | Fidi et al. | 181/129 |
| 4,993,074 | A | * | 2/1991 | Carroll | 381/373 |
| 5,675,658 | A | * | 10/1997 | Brittain | 381/72 |
| 5,844,998 | A | * | 12/1998 | Nageno | 381/371 |
| 5,970,160 | A | * | 10/1999 | Nilsson et al. | 381/371 |
| 6,151,717 | A | * | 11/2000 | Lindgren et al. | 2/209 |
| RE37,398 | E | * | 10/2001 | Nageno | 381/371 |
| 8,111,858 | B2 | * | 2/2012 | Sapiejewski | 381/372 |
| 8,442,258 | B2 | * | 5/2013 | Kimura | 381/378 |
| 2003/0026438 | A1 | * | 2/2003 | Ray et al. | 381/71.11 |
| 2006/0188121 | A1 | * | 8/2006 | Tsunoda | 381/374 |
| 2006/0269090 | A1 | * | 11/2006 | Sapiejewski | 381/371 |
| 2009/0232340 | A1 | * | 9/2009 | Yang | 381/371 |
| 2010/0027803 | A1 | * | 2/2010 | Sapiejewski | 381/71.6 |
| 2010/0284558 | A1 | * | 11/2010 | Kimura et al. | 381/333 |
| 2011/0188696 | A1 | * | 8/2011 | Kimura | 381/378 |
| 2011/0286607 | A1 | * | 11/2011 | Kimura | 381/71.6 |

FOREIGN PATENT DOCUMENTS

| | | | | |
|---|---|---|---|---|
| JP | 54-87523 | A | | 7/1979 |
| JP | 64-7490 | U | | 1/1989 |
| JP | 2008-099127 | A | | 4/2008 |
| JP | 2009-010485 | A | | 1/2009 |
| JP | 2009-017176 | A | | 1/2009 |
| JP | 2009218687 | A | * | 9/2009 |
| JP | 2010263460 | A | * | 11/2010 |
| JP | 2011015338 | A | * | 1/2011 |
| JP | 2011160310 | A | * | 8/2011 |

OTHER PUBLICATIONS

Japanese Office Action for Patent Application No. 2009-159728, dated Apr. 16, 2013.

* cited by examiner

*Primary Examiner* — Mohammad Islam
*Assistant Examiner* — Phylesha Dabney
(74) *Attorney, Agent, or Firm* — Sughrue Mion, PLLC

(57) ABSTRACT

An earmuff and a headphone includes: a headband; an ear cup attached to the headband; a baffle board fixed on the ear cup; an ear pad engaged to the baffle board. An air-permeable member provided between the baffle board and the ear pad.

19 Claims, 5 Drawing Sheets

EARMUFF AND HEADPHONE

BACKGROUND OF THE INVENTION

1. Field of the Invention

The present invention relates to an earmuff and a headphone having a structure of the earmuff, and more particularly, the present invention relates to an earmuff and a headphone in which a large volume of a front air chamber can be secured by providing an air-permeable member between a baffle board and an ear pad.

2. Description of the Related Art

A longitudinal cross-sectional view of a conventional earmuff is exemplary illustrated in FIG. 5. As illustrated in FIG. 5, in an earmuff 60, an ear pad 63 is fixed to a baffle board 62 that covers an opening of an ear cup 61. A front air chamber 64 is a space surrounded by the baffle board 62 and the ear pad 63 and is in communication with an external auditory meatus of a wearer.

The baffle board 62 has a shape in which two torus-shaped members having an outer diameter different from each other are separated in an axial direction. The front torus-shaped member has a flange 621 formed on an outer periphery. A flap 631 that is a part of a skin member of the ear pad 63 covers the flange 621. The flap 631 is made of a flexible material. With the flexibility, the flap 631 is attached and engaged to the flange 621. The flap 631 may incorporate rubber material and may cover the flange 621 with expansion and contraction of the rubber material to be engaged thereto.

The ear pad 63 is fixed to the baffle board 62 with the flap 631 covering the flange 621. The baffle board 62 has a groove 622 formed on the entire periphery thereof at a portion between the flange 621 and the outer edge of the baffle board 62 body.

A headband, not illustrated in the figure, is attached to the earmuff 60 at the outer side of the ear cup 61. The headband is made of an elastic material and applies pressing force in the direction towards the ear pad 63. On the other end of the headband, another earmuff 60 is attached in an opposing manner, thereby forming a pair.

In a conventional earmuff having the above described structure, the ear pad is pressed to an auricle or a skin thereround of a wearer to be in close contact thereto, with pressing force applied by a headband. Thus, the earmuff has external noise insulation property. A headphone in which a speaker unit is provided to an earmuff having the above described structure can prevent output sound from leaking outside. Sound insulation property of such an earmuff can be effectively improved by providing a large ear pad.

However, a large ear pad increases the size of an earmuff as a whole, thereby making it less comfortable for the user. Moreover, the size of an ear pad cannot be increased over a certain level.

A headphone is known having an improved sound insulation property without increasing the size of an ear pad (see, for example, Japanese Patent Application Publication 2009-17176). In the headphone, a front air chamber not in communication with a rear air chamber is secured so that attenuation of transmission of received external noise can be improved.

A front air chamber plays a significant roll in improving sound insulation property of an earmuff. A larger volume of a front air chamber provides higher sound insulation property. In the conventional earmuff 60 as shown in FIG. 5, the volume of the front air chamber 64 is compromised as much as the depth of the groove 622, i.e., the distance from the periphery of the baffle board 62 to the bottom of the groove 622. Thus, the volume of the front air chamber 64 and the sound insulation is limited.

In the headphone disclosed in Japanese Patent Application Publication No. 2009-17176, the volume of the front air chamber is secured with the thickness of the ear pad. Still, with the ear pad being compressed by pressing force applied by the headband while the headphone is worn, the volume of the front air chamber becomes small.

The volume of a front air chamber can be made large by providing a hole that communicates the internal space of an ear pad with the front air chamber at a portion of the ear pad on the front air chamber side. Unfortunately, a hole on an ear pad transmits received external noise and insulation against noises in certain frequencies dramatically changes. Further, in a headphone with the internal space of an ear pad communicated with a front air chamber communicating with an outer auditory meatus, reproduced sound is more likely to be leaked outside, and thus sound insulation towards the outside is low.

SUMMARY OF THE INVENTION

The present invention is made in view of the above circumstance and an object of the present invention is to provide an earmuff in which an air-permeable member is provided between an ear pad and the front surface of the baffle board so that large volume of a front air chamber can be secured while the earmuff is worn by the user with the thickness, hardness, and a cushioning property of the air-permeable member.

An aspect of the present invention is an earmuff including: a headband; an ear cup attached to the headband; a baffle board fixed on the ear cup; an ear pad engaged to the baffle board. An air-permeable member is provided between the baffle board and the ear pad.

Preferably, in the earmuff, the thickness of the air-permeable member is higher than that of the ear pad.

Preferably, in the earmuff, the air-permeable member is made of a member having a cushioning property.

Preferably, in the earmuff, the air-permeable member is made of a member having a lower cushioning property than that of the ear pad.

Preferably, in the earmuff, the air-permeable member is made of an air-permeable acoustic absorbing member.

Preferably, in the earmuff, the baffle board has a ribbed wall at a periphery on the ear pad side.

Preferably, in the earmuff, the baffle board has at least one communicating hole that acoustically connects the front air chamber and the rear air chamber.

Preferably, in the earmuff, the baffle board has at least one communicating hole that acoustically connects the front air chamber and the rear air chamber, and the communicating hole is provided with an acoustic resistor at least on a front air chamber side or a rear air chamber side.

Another aspect of the present invention is a headphone including: a headband; an ear cup attached to the headband; a baffle board fixed on the ear cup and providing thereon a speaker unit that outputs an audible signal; an ear pad engaged to the baffle board. An air-permeable member is provided between the baffle board and the ear pad.

Preferably, in the headphone, the thickness of the air-permeable member is higher than that of the ear pad.

Preferably, in the headphone, the air-permeable member is made of a member having a cushioning property.

Preferably, in the headphone, the air-permeable member is made of a member having a lower cushioning property than that of the ear pad.

Preferably, in the headphone, the air-permeable member is made of an air-permeable acoustic absorbing member.

Preferably, in the headphone, the baffle board has a ribbed wall at a periphery on the ear pad side.

Preferably, in the headphone, the baffle board has at least one communicating hole that acoustically connects the front air chamber and the rear air chamber.

Preferably, in the headphone, the baffle board has at least one communicating hole that acoustically connects the front air chamber and the rear air chamber, and the communicating hole is provided with an acoustic resistor at least on a front air chamber side or a rear air chamber side.

Still another aspect of the present invention is a noise canceling headphone including: a headband; an ear cup attached to the headband; a baffle board fixed on the ear cup and providing thereon a speaker unit that outputs an audible signal; an ear pad engaged to the baffle board; a microphone that is provided on the ear cup or the baffle board and corrects surrounding noise to be converted into an electrical signal; a canceling signal producing unit that produces a canceling signal that cancels out the electrical signal converted by the microphone; and a combining unit that combines the canceling signal and an audio signal to be output from the speaker unit. An air-permeable member is provided between the baffle board and the ear pad.

In the present invention, the air-permeable member is provided between the front side of the baffle board and the ear pad. Therefore, the volume of the front air chamber does not decrease by the lateral pressure applied by the headband. Thus, the earmuff and the headphone with improved insulation against external noise can be obtained.

In the present invention, by providing the ribbed wall on the front surface of the baffle board, the volume of the front air chamber can be more surely prevented from decreasing by the lateral pressure applied by the headband, and the volume of the front air chamber can be secured sufficiently. Thus, the earmuff and the headphone with improved insulation against external noise can be obtained.

In the present invention, with the hole on the baffle board communicating the front air chamber and the rear air chamber, larger volume of the front air chamber can be obtained. Thus, the earmuff and the headphone with improved insulation against external noise can be obtained.

In the present invention, the acoustic resistor is provided at the communication hole on the baffle board. Thus, the earmuff and the headphone with improved insulation against external noise with the adjustable acoustic resistance can be obtained.

DETAILED DESCRIPTION OF THE PREFERRED EMBODIMENTS

First Embodiment

Figure 1:
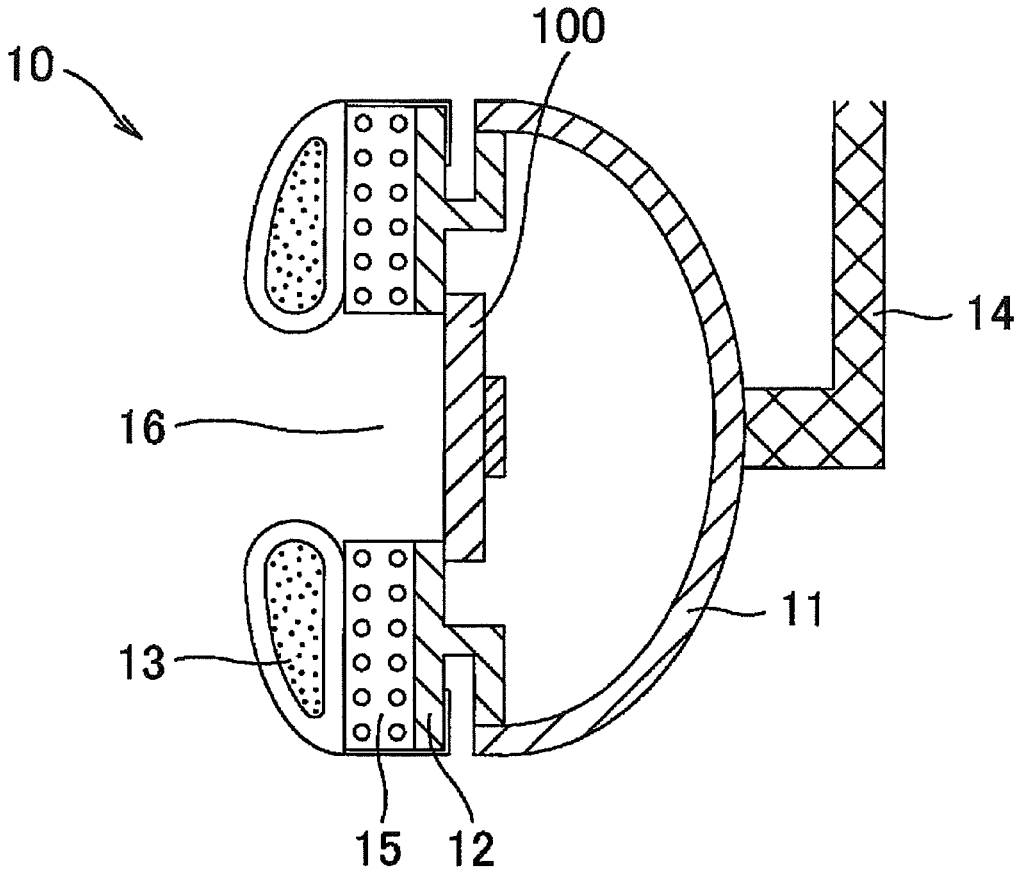
FIG. 1 is a longitudinal sectional view of an embodiment of an earmuff according to the present invention.

An embodiment of an earmuff according to the present invention is described below with reference to some of the drawings. FIG. 1 is a longitudinal sectional view exemplary illustrating an earmuff according to the present invention. In this earmuff 10 illustrated in FIG. 1, a baffle board 12 is fixed at an opening of an ear cup 11, and an ear pad 13 is fixed to the baffle board 12.

The baffle board 12 has a shape in which two torus-shaped members having an outer diameter different from each other are separated in an axial direction, and are integrally connected.

A headband 14 made of a flexible member and applies pressing force in the direction towards the ear pad 13 is attached to the ear cup 11 at a position substantially at the center of the outer surface of the ear cup 11. The other end of the headband 14 is attached to another earmuff 10 having the same shape as the above described earmuff 10.

The ear pad 13 is mainly composed of a torus-shaped cushioning member (e.g., a sponge material), and a skin member of the ear pad 13 covers the cushioning member. An engaging unit that is an outwardly extended part of the skin member covers the periphery of the front torus-shaped member of the baffle board 12 to be engaged thereto with a certain degree of adhesion. The engaging member of the ear pad 13 is made of a flexible material as in the conventional ear pad. The engagement member can be mounted on the periphery of the baffle board 12 with its flexibleness. The engaging member may incorporate a rubber material.

The ear pad 13 is torus shaped and has a diameter substantially as same as that of the baffle board 12. The ear pad 13 is filled with a cushioning material that disperses pressing force applied to the earmuff 10 in a worn state to allow the user to comfortably wear the earmuff 10.

An air-permeable cushioning member 15 of a certain thickness is provided between the baffle board 12 and the ear pad 13. The air-permeable cushioning member 15 is torus shaped and has a diameter substantially the same as that of the baffle board 12. The air-permeable cushioning member 15 is hard enough to not be crushed by the pressing force applied by the headband 14 while the earmuff 10 is being worn. The air-permeable cushioning member 15 may be fixed to the baffle board 12 or to the ear pad 13 by adhesion.

The front air chamber 16 includes a space surrounded by the baffle board 12 and the ear pad 13 and defined by the thickness of the air-permeable cushioning member 15.

The air-permeable cushioning member 15 incorporates a layer of air that can also be counted as the volume of the front air chamber 16.

Sound insulation property of the earmuff according to the present invention is exemplary described below. In the earmuff 10 according to the present embodiment, an external noise of mid and high-tone range, i.e., noises equal to or higher than 400 Hz are blocked by the ear pad 13. An external noise in the tone lower than that, i.e., noise below 400 Hz is not blocked by the ear pad 13 but can be blocked by the space of the front air chamber 16.

Figure 4:
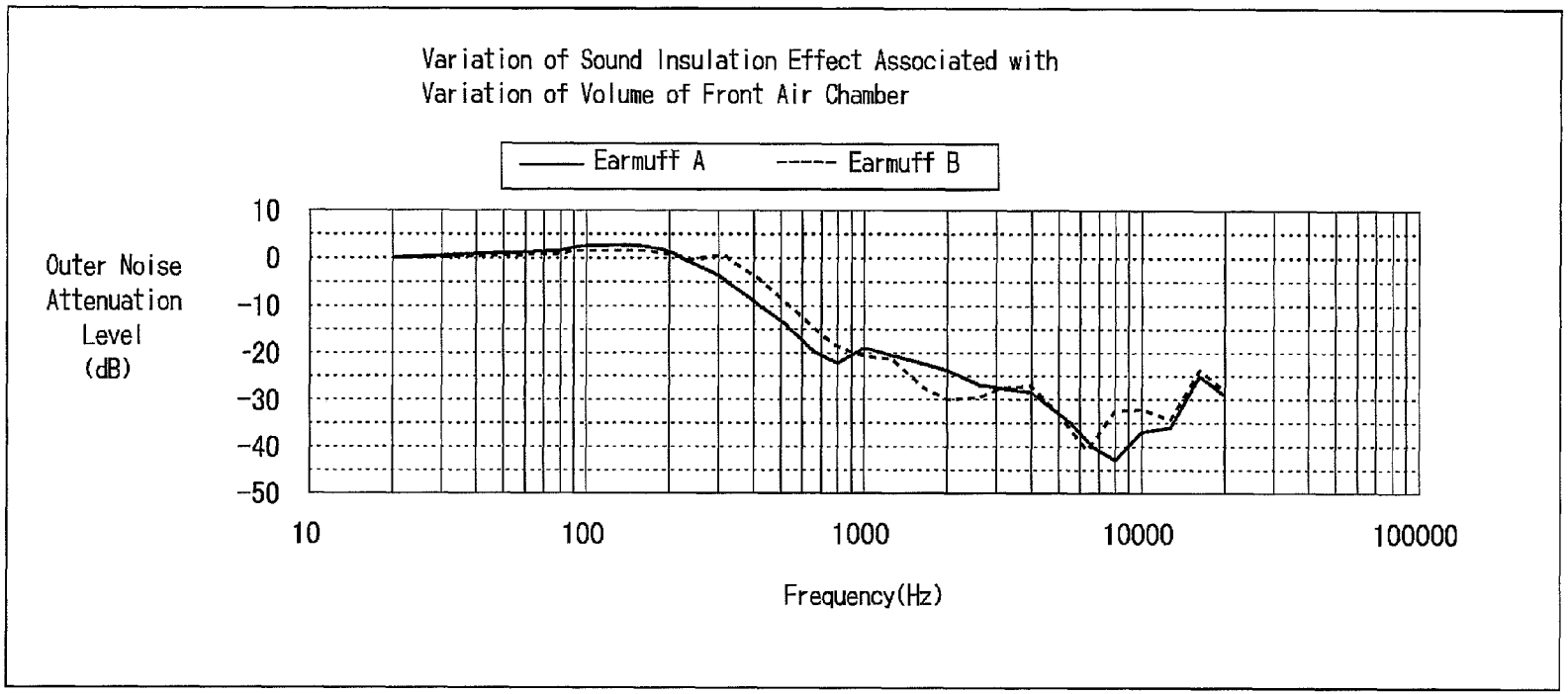
FIG. 4 is a graph depicting a relationship between the volume of a front air chamber and sound insulation of the earmuff.
Figure 5:
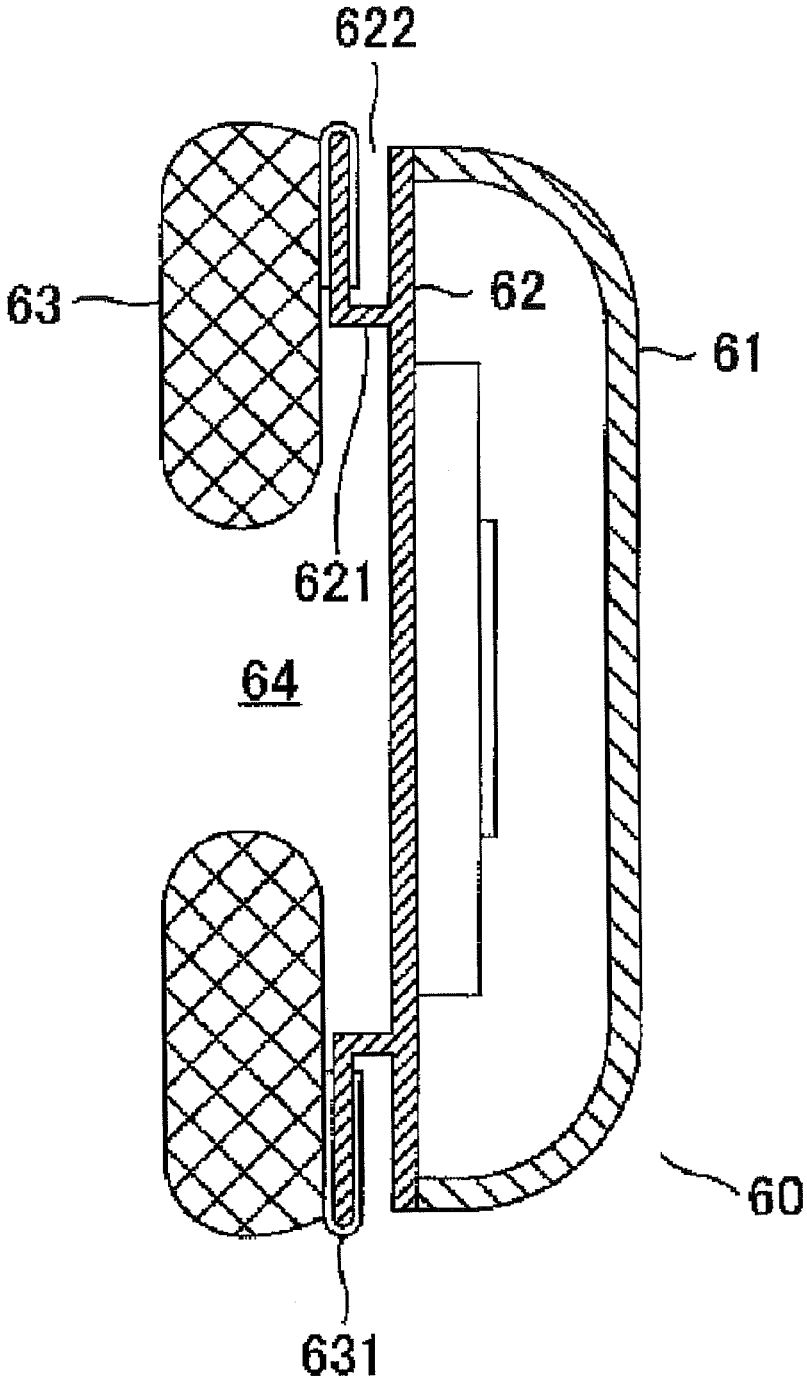
RELATED ART FIG. 5
FIG. 5 is a longitudinal cross-sectional view of a conventional earmuff.

FIG. 4 is a graph depicting an external noise insulation property of two earmuffs having different volumes of the front air chamber. In FIG. 4, the solid line represents the sound insulation property of an earmuff A in which the volume of a front air chamber is approximately 25 cc, and the dotted line represents the sound insulation property of an earmuff B in which the volume of a front air chamber is approximately 15 cc.

In FIG. 4, the horizontal axis, which is a logarithmic axis, represents frequency and the vertical axis represents attenuation level of external noise.

As depicted in FIG. 4, the earmuffs A and B can both attenuate external noise with high frequencies. Nevertheless, compared with the earmuff B, the earmuff A can more effectively attenuate noise with lower frequencies, and thus has higher sound insulation property.

In FIG. 4, frequencies of an external noise that are attenuated by the earmuff A and B for the level of −3 dB are about 250 Hz and 350 Hz, respectively. Therefore, the earmuff A of a volume of the front air chamber larger than that of the earmuff B can exert higher insulation against a noise with lower frequencies, thereby exerting higher sound insulation against the main frequency band of external noise.

When the earmuff 10 according to the present embodiment is worm by the user, the ear pad 13 is in close contact with an auricle or a skin around the auricle of the user by the pressing force applied by the headband 14 towards the auricle or the skin, and repelling force caused by a cushioning member therein being compressed to some extent with the pressing force. Thus, the earmuff 10 can insulate external noise in mid- to high tone range. The front air chamber 16 secured with a certain amount of volume by the air-permeable cushioning member 15 enables the earmuff 10 to insulate noise in low-tone range.

External noise of equal to or more than 250 Hz can be attenuated for roughly −3 dB by securing the volume of the front air chamber 16 for about 25 CC with the thickness of the air-permeable cushioning member 15. Thus, the sound insulation property can be further improved with the front air chamber 16 as well as with the ear pad 13.

The sound insulation property can be improved even higher if an air-permeable acoustic absorbing member is used as the air-permeable cushioning member 15.

In the embodiment of the earmuff according to the present invention as described above, a large volume of the front air chamber can be secured and insulation against external noise with a low frequency that passes through the ear pad can be improved. A frequency band against which the sound insulation property should be improved can be selected according to the thickness of the air-permeable cushioning member. Further, even if an ear pad is compressed, a certain volume of the front air chamber can be secured without compromising the degree of adhesiveness and comfortable wearing of the user.

Second Embodiment

Figure 2:
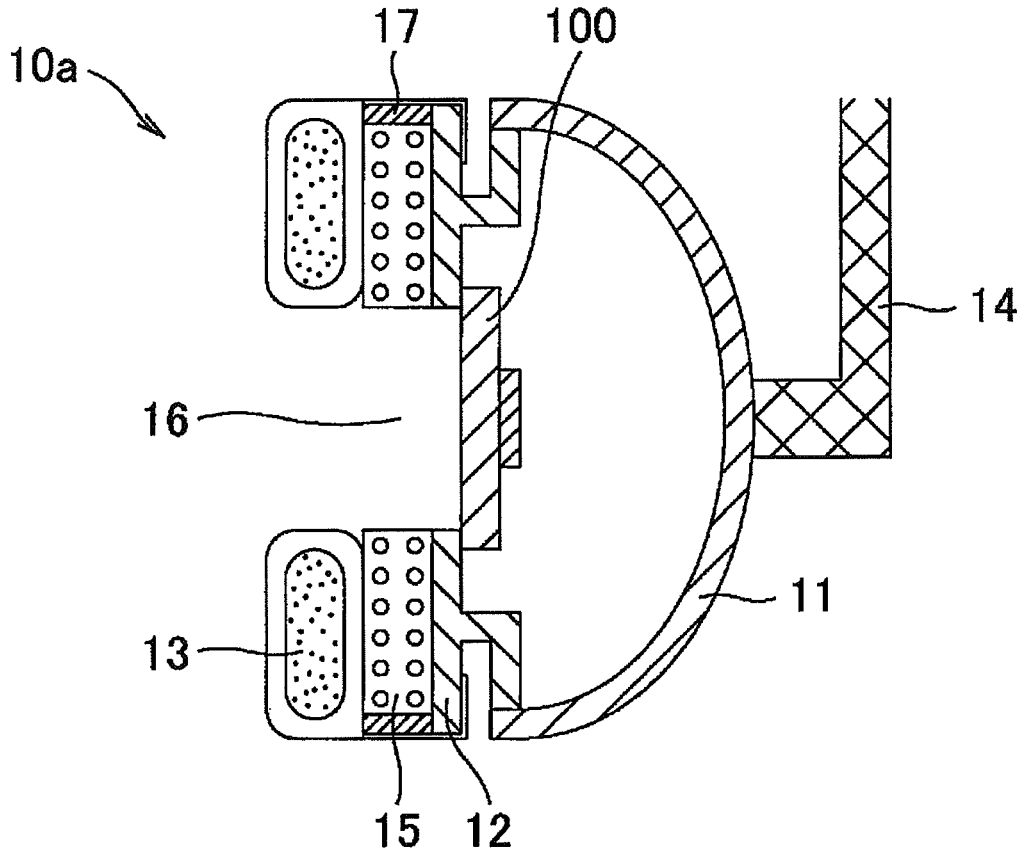
FIG. 2 is a longitudinal sectional view of another embodiment of an earmuff according to the present invention.

Another embodiment of an earmuff according to the present invention is described below with reference to FIG. 2. In this earmuff 10*a* illustrated in FIG. 2, a ribbed wall 17 is provided on the periphery of the front torus-shaped member of the baffle board 12 in the above-described first embodiment. The ribbed wall 17 may be an end portion of the baffle board 12 extended and folded, or be a ring shaped member being adhered to the baffle board 12 and having a certain thickness and an external diameter substantially the same as that of the external diameter of the baffle board 12.

The height of the ribbed wall 17 is equal to or slightly larger than the thickness of the air-permeable cushioning member 15 (the distance between the baffle board 12 and the ear pad 13). Thus, even if the ear pad 13 is compressed by pressing force applied by the headband 14 while the earmuff 10*a* is being worn, the air-permeable cushioning member 15 is protected from being compressed by the ribbed wall 17. Thus, the volume of the front air chamber 16 can be secured.

In the earmuff 10*a* according to the present embodiment, even with the increased degree of adhesiveness between the ear pad and the user, certain volume of the front air chamber can be more surely secured compared with the conventional earmuff. Thus, sound insulation property can be improved.

Third Embodiment

Figure 3:
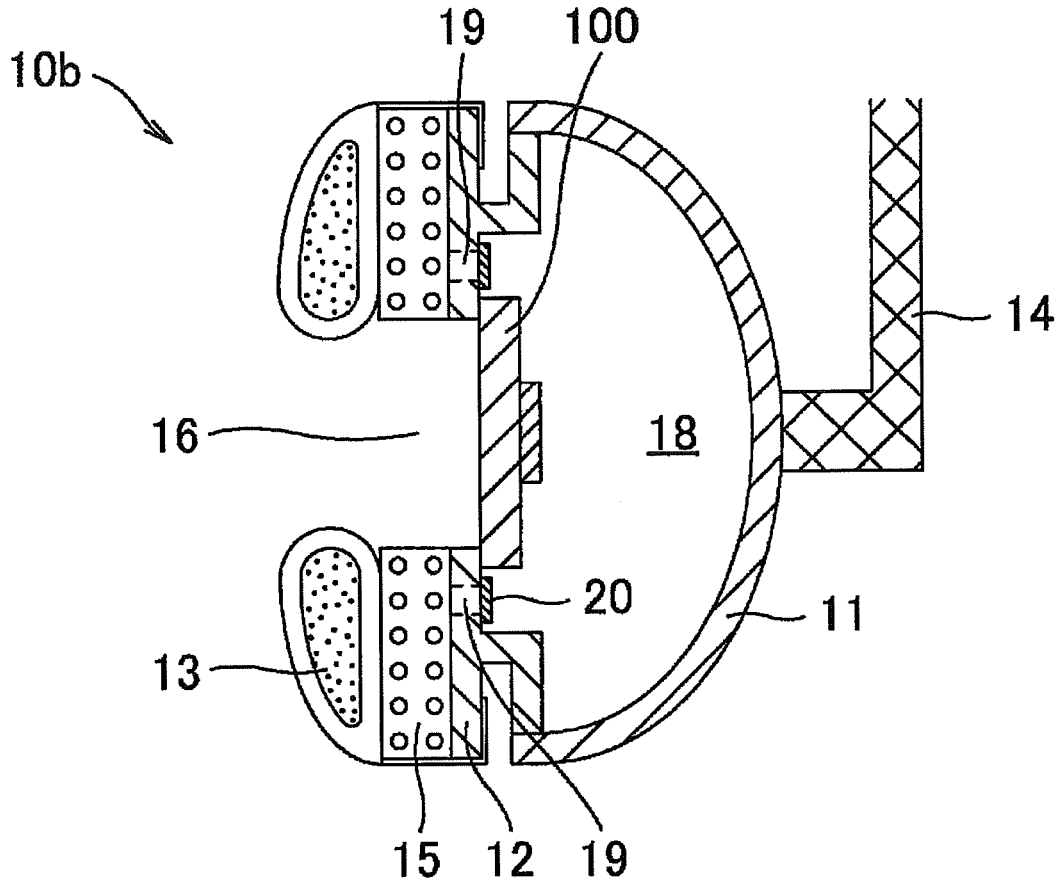
FIG. 3 is a longitudinal sectional view of still another embodiment of an earmuff according to the present invention.

Still another embodiment of an earmuff according to the present invention is described below with reference to FIG. 3. In an earmuff 10*b* illustrated in FIG. 3, a baffle board 12*a* is provided with a communication hole 19 that acoustically communicates the front air chamber 16 and a rear air chamber 18. The rear air chamber 18 is an inner space of the ear cup 11. The front air chamber 16 and an air layer of the rear air chamber 18 are communicated through the communication hole 19. Thus, the volumes of both rear air chamber 18 and front air chamber 16 can effectively contribute to the sound insulation property. Accordingly, the insulation against external noise can be further improved.

The sound insulation property and the acoustic characteristics of the earmuff 10*b* according to the present embodiment can be controlled by attaching an acoustic resister 20 on the communication hole 19 on the rear air chamber 18 side. The sound insulation property can be improved and at the same time, the acoustic characteristic of the earmuff 10*b* can be controlled. Therefore, an earmuff with even higher sound insulation property and excellent acoustic characteristics can be obtained.

The sound insulation property and the acoustic characteristics can be controlled by controlling the acoustic characteristics of the communication hole 19 by the acoustic resister 20. The acoustic resistor 20 may be made of any materials having acoustic load property such as paper, cloth, and meshed material, and may be attached on the front air chamber 16 side.

In the earmuff 10*b* according to the present embodiment, the volume of the front air chamber can be made larger compared with that of the front air chamber in the conventional earmuff, and thus the earmuff 10*b* has higher sound insulation property. Further, with an acoustic resister attached on the communication hole, the sound insulation property and the acoustic characteristics can be controlled.

Fourth Embodiment

A headphone having the above sound insulation can be obtained by providing a speaker unit that outputs an audible signal on the baffle board of the earmuff according to the present invention. The embodiments illustrated in FIGS. 1 to 3 are supposed to form a headphone. The headphone can be formed by installing a speaker unit 100 on the rear surface of the baffle board 12 and forming an opening through which sounds emitted by the speaker unit 100 pass on the baffle board 12.

The headphone according to the present invention has sound insulation property high as that of the above described earmuff. The space inside the ear pad is not in communication with the outside nor the space inside the front air chamber, i.e., provided as an isolated space. Thus, a closed-type headphone is provided in which the space inside the ear pad effectively blocks the external noise in mid- and high-range tone, and the frequency characteristics of the reproduced sound is not affected by the external sound.

Fifth Embodiment

A noise canceling head phone having the above described excellent sound insulation property can be obtained by adding, to an earmuff of the above described structure, a microphone that collects external noise, a canceling signal producing circuit that produces a canceling signal that can cancel out the external noise collected by the microphone, and a combining unit that combines the canceling signal and an audio signal and outputs the resultant signal from the speaker unit. The embodiments illustrated in FIGS. 1 to 3 are supposed to form a noise canceling headphone. The noise canceling headphone can be formed by installing a speaker unit 100 on the rear surface of the baffle board 12 and forming an opening through which sounds emitted by the speaker unit 100 pass on the baffle board 12.

The noise canceling headphone according to the present invention has sound insulation property as high as that of the earmuff. The space inside the ear pad is not in communication with the outside nor the space inside the front air chamber, i.e., provided as an isolated space. Thus, a closed-type noise cancelling headphone is provided in which the space inside the ear pad effectively blocks the external noise in mid- and high-tone range, and the frequency characteristics of the reproduced sound is not affected by the external noise.

According to the present invention, an earmuff and a head phone having excellent sound insulation property can be provided. The earmuff can be of an ear covering type or an on-ear type as long as it is a closed type.

What is claimed is:

1. An earmuff comprising:

a headband;

an ear cup attached to the headband;

a baffle board which has a first side and is fixed to the ear cup;

an ear pad which has a second side proximate the first side of the baffle board and is engaged to the baffle board; and an air-permeable member interposed between the first side of the baffle board and the second side of the ear pad, wherein the baffle board has a ribbed wall which is disposed adjacent the air-permeable member and is interposed between the first side of the baffle board and the second side of the ear pad.

2. The earmuff according to claim 1, wherein a thickness of the air-permeable member is greater than a thickness of the ear pad.

3. The earmuff according to claim 1, wherein the air-permeable member is made of a member having a cushioning property.

4. The earmuff according to claim 1, wherein the air-permeable member is made of a material having a cushioning property which is lower than a cushioning property of the ear pad.

5. The earmuff according to claim 1, wherein the air-permeable member is made of an air-permeable acoustic absorbing material.

6. The earmuff according to claim 1, wherein the baffle board has at least one communicating hole that acoustically connects a front air chamber and a rear air chamber.

7. The earmuff according to claim 1, wherein the baffle board has at least one communicating hole that acoustically connects a front air chamber and a rear air chamber, and the communicating hole is provided with an acoustic resistor at least on a front air chamber side or a rear air chamber side.

8. The earmuff according to claim 1, wherein the baffle board is torus-shaped and has a diameter of an inner periphery different from a diameter of an outer periphery.

9. The earmuff according to claim 1, wherein the ribbed wall is disposed on an outer periphery of the air-permeable member, a diameter of an inner periphery of the air-permeable member substantially conforms to a diameter of an inner periphery of the baffle board, and a diameter of an outer periphery of the ribbed wall substantially conforms to a diameter of an outer periphery of the baffle board.

10. The earmuff according to claim 1, further comprising:

a front air chamber disposed on a side of an ear, wherein an inner diameter of the air-permeable member defines a cross-sectional dimension of the front air chamber.

11. The earmuff according to claim 1, wherein the air-permeable member increases a volume of a front air chamber surrounded by the baffle board and the ear pad.

12. A headphone comprising:

a headband;

an ear cup attached to the headband;

a baffle board which has a first side and is fixed to the ear cup;

a speaker unit disposed on the baffle board and configured to output an audible signal;

an ear pad which has a second side proximate the first side of the baffle board and is engaged to the baffle board; and an air-permeable member interposed between the first side of the baffle board and the second side of the ear pad, wherein the baffle board has a ribbed wall which is disposed adjacent the air-permeable member and is interposed between the first side of the baffle board and the second side of the ear pad.

13. The headphone according to claim 12, wherein a thickness of the air-permeable member is greater than a thickness of the ear pad.

14. The headphone according to claim 12, wherein the air-permeable member is made of a material having a cushioning property.

15. The headphone according to claim 12, wherein the air-permeable member is made of a material having a cushioning property is lower than a cushioning property of the ear pad.

16. The headphone according to claim 12, wherein the air-permeable member is made of an air-permeable acoustic absorbing material.

17. The headphone according to claim 12, wherein the baffle board has at least one communicating hole that acoustically connects a front air chamber and a rear air chamber.

18. The headphone according to claim 12, wherein the baffle board has at least one communicating hole that acoustically connects the front air chamber and the rear air chamber, and the communicating hole is provided with an acoustic resistor at least on a front air chamber side or a rear air chamber side.

19. A noise canceling headphone comprising:

a headband;

an ear cup attached to the headband;

a baffle board which has a first side and is fixed to the ear cup;

a speaker unit disposed on the baffle board and configured to output an audible signal;

an ear pad which has a second side proximate the first side of the baffle board and is engaged to the baffle board;

a microphone that is provided on the ear cup or the baffle board and corrects surrounding noise to be converted into an electrical signal;

a canceling signal producing unit that produces a canceling signal that cancels out the electrical signal converted by the microphone;

a combining unit that combines the canceling signal and an audio signal to be output from the speaker unit; and an air-permeable member interposed between the first side of the baffle board and the second side of the ear pad, wherein the baffle board has a ribbed wall which is disposed adjacent the air-permeable member and is interposed between the first side of the baffle board and the second side of the ear pad.

* * * * *